US008428491B2

(12) United States Patent
Yamamoto

(10) Patent No.: US 8,428,491 B2
(45) Date of Patent: Apr. 23, 2013

(54) IMAGE FORMING APPARATUS

(75) Inventor: Tatsuyuki Yamamoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 294 days.

(21) Appl. No.: 13/005,023

(22) Filed: Jan. 12, 2011

(65) Prior Publication Data

US 2011/0170907 A1 Jul. 14, 2011

(30) Foreign Application Priority Data

Jan. 13, 2010 (JP) ..... 2010-004888

(51) Int. Cl.
*G03G 15/04* (2006.01)

(52) U.S. Cl.
USPC ..... 399/119

(58) Field of Classification Search ..... 399/111, 399/113, 119, 120
See application file for complete search history.

(56) References Cited

U.S. PATENT DOCUMENTS 5,019,867 A * 5/1991 Yamakawa et al. ..... 399/119

FOREIGN PATENT DOCUMENTS

JP 06-51575 * 2/1994
JP 06-161331 * 6/1994
JP 11-327296 A 11/1999

* cited by examiner

*Primary Examiner* — Hoang Ngo
(74) *Attorney, Agent, or Firm* — Fitzpatrick, Cella, Harper & Scinto

(57) ABSTRACT

An image forming apparatus includes an image bearing member; a developing device for forming a toner image on the image bearing member while carrying a developer on a developer carrying member, wherein the developing device is mountable and demountable relative to a main assembly of the apparatus in a direction substantially parallel with a radial direction of the image bearing member; an urging mechanism for urging the developing device toward the surface of the image bearing member; and a moving mechanism, movable in a movement path of the developing device, for moving the developing device between a developing position in which development can be effected and a retracted position retracted from the developing position in a state in which the developing device is urged by the urging mechanism. The moving mechanism is temporarily retracted from an inside of the movement path of the developing device to an outside of the movement path of the developing device by a mounting and demounting operation of the developing device.

3 Claims, 5 Drawing Sheets

IMAGE FORMING APPARATUS

FIELD OF THE INVENTION AND RELATED ART

The present invention relates to an image forming apparatus in which a developing device is demountable from a casing by being moved is a direction in which a developer carrying member is retracted from an image bearing member. Specifically, the present invention relates to a mechanism for moving the developing device in a demounting direction by a predetermined distance by an operation of a manual operation member.

The image forming apparatus including the developing device for developing an electrostatic image formed on the image bearing member into a toner image with a developer carried on the developer carrying member has been widely used. The developing device is mounted on a casing of the image forming apparatus so that the image bearing member and the developer carrying member are opposed to each other with a predetermined spacing (clearance).

In the case where the image bearing member and the developing device are separately mounted to the casing of the image forming apparatus, a mechanism as described below is provided so that the image bearing member can be demounted from a main assembly of the image forming apparatus without demounting the developing device from the image forming apparatus. That is, a contacting means releasing mechanism (spacing mechanism) for ensuring the predetermined spacing between the developer carrying member and the image bearing member by operating the manual operation member to retract the developing device from the image bearing member is provided. This is because unnecessary contact and development between the image bearing member and the developer carrying member of the developing device are not caused during mounting and demounting of the image bearing member, maintenance of the developing device, or the like. As a result, the image bearing member can be demounted from the main assembly without taking the trouble to demount the developing device.

In Japanese Laid-Open Patent Application (JP-A) Hei 11-133730 and JP-A Hei 7-92801, the image forming apparatus in which the developing device is movable in a horizontal direction is disclosed, wherein the predetermined spacing is ensured between the developer carrying member and the image bearing member by operation the manual operation member to retract the developing device in the horizontal direction, i.e., the contact between the developer carrying member and the image bearing member is released.

In the conventional image forming apparatus, a structure for demounting and mounting the developing device from a front surface side of the image forming apparatus by moving the developing device in a longitudinal direction of the image bearing member is usually employed. In this case, as described in JP-A Hei 11-133730 and JP-A Hei 7-92801, in addition to a guide portion which is provided along the longitudinal direction of the image bearing member and is used for pulling out the developing device to the front surface side, a space in which the contact of the developer carrying member with the image bearing member is released is required.

On the other hand, in the case where the developing device is demounted from a side surface side of the image forming apparatus by moving the developing device in a direction in which the developer carrying member is spaced from the image bearing member, the guide portion used during the demounting of the developing device can be utilized as the space in which the contact of the developer carrying member with the image bearing member is released. Therefore, space saving can be realized.

However, in the case, as described in JP-A Hei 11-133730 and JP-A Hei 7-92801, the contacting means releasing mechanism for releasing the contact of the developer carrying member with the image bearing member is located in a path in which the developing device is pulled out and thus obstructs the pulling movement of the developing device.

SUMMARY OF THE INVENTION

A principal object of the present invention is to provide an image forming apparatus in which a mechanism for forming a predetermined spacing does not prevent a developing device from being pulled out even in a constitution in which at least a part of a mechanism for releasing contact of a developer carrying member with an image bearing member is provided in a path in which the developing device is pulled out.

According to an aspect of the present invention, there is provided an image forming apparatus comprising:

an image bearing member;

a developing device for forming a toner image on the image bearing member while carrying a developer on a developer carrying member, wherein the developing device is mountable and demountable relative to a main assembly of the apparatus in a direction substantially parallel with a radial direction of the image bearing member;

an urging mechanism for urging the developing device toward the surface of the image bearing member; and a moving mechanism, movable in a movement path of the developing device, for moving the developing device between a developing position in which development can be effected and a retracted position retracted from the developing position in a state in which the developing device is urged by the urging mechanism, wherein the moving mechanism is temporarily retracted from an inside of the movement path of the developing device to an outside of the movement path of the developing device by a mounting and demounting operation of the developing device.

These and other objects, features and advantages of the present invention will become more apparent upon a consideration of the following description of the preferred embodiments of the present invention taken in conjunction with the accompanying drawings.

Figure 3:
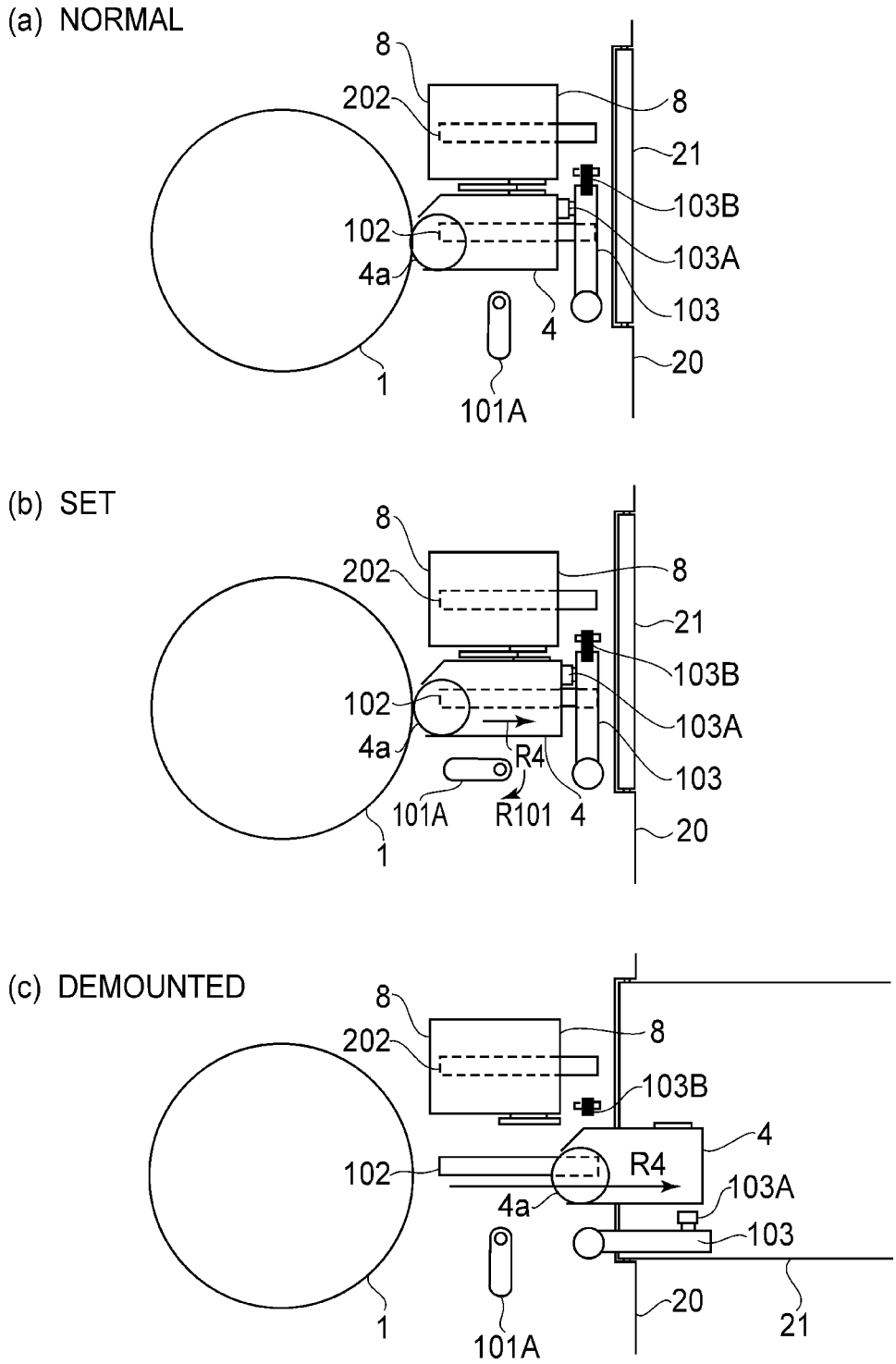

Parts (a) to (c) of FIG. 3 are illustrations of a mechanism for mounting and demounting the developing device and for releasing contact of the developing device.

Figure 4:
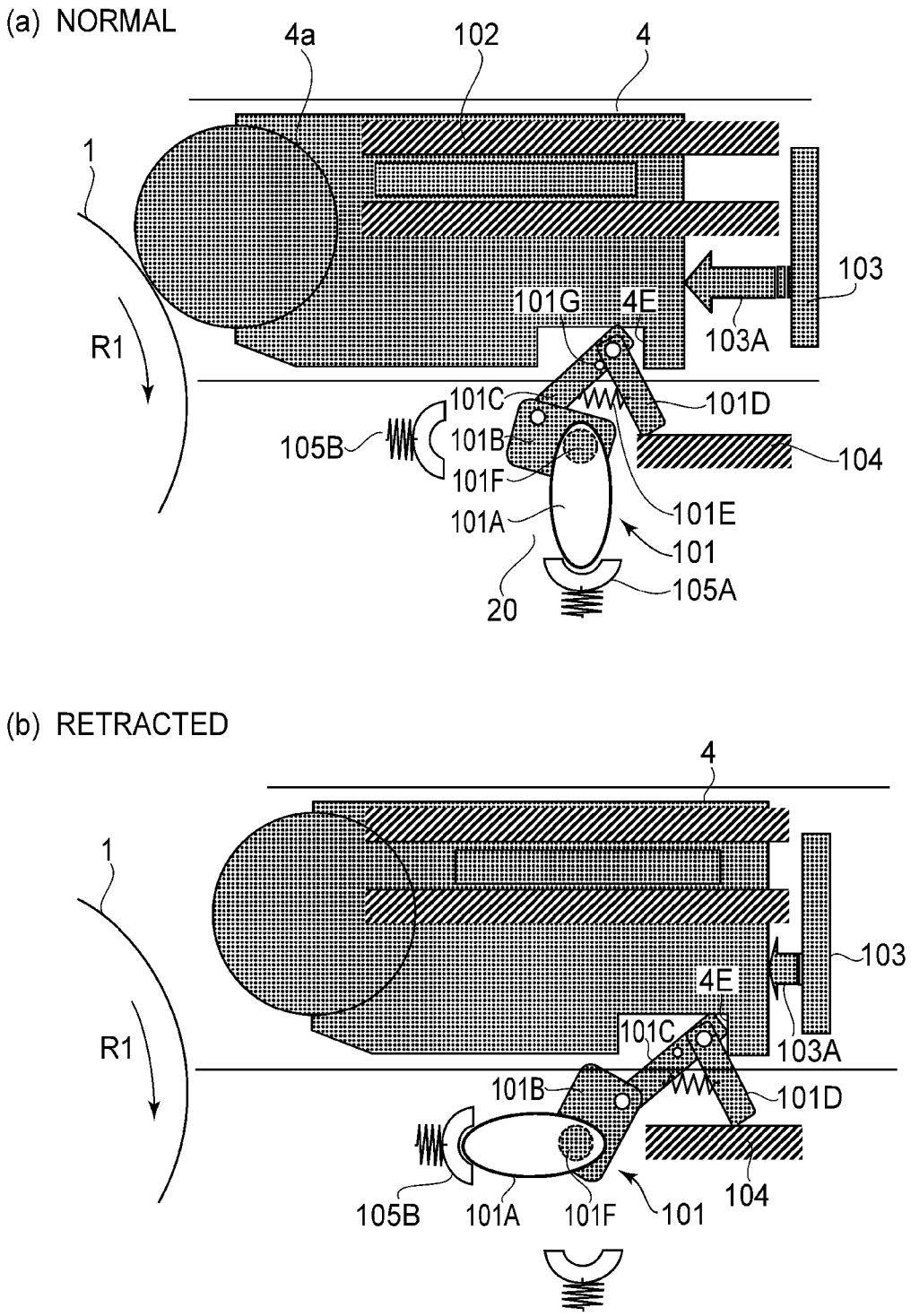

Parts (a) and (b) of FIG. 4 are illustrations of a spacing operation of the developing device.

Figure 5:
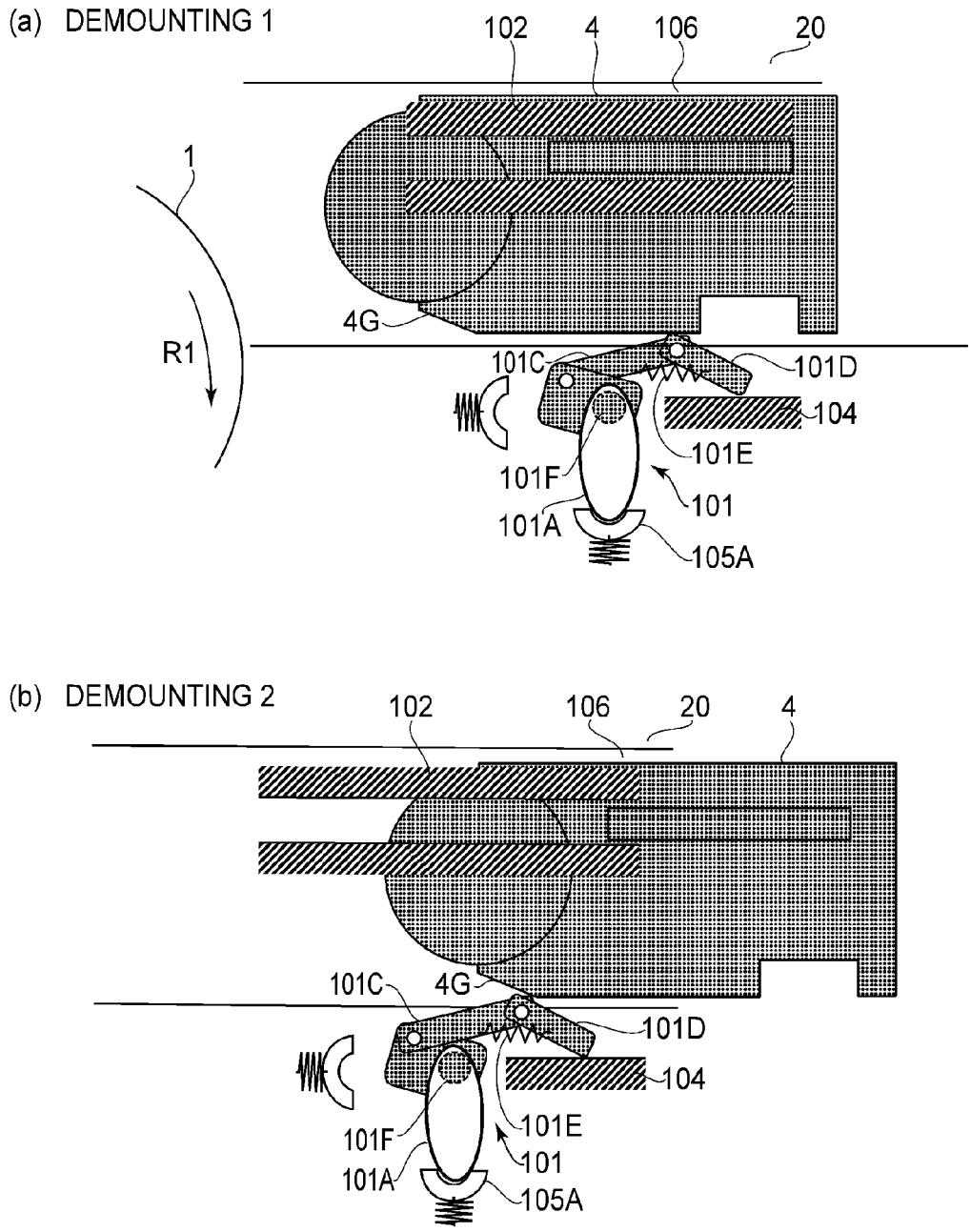

Parts (a) and (b) of FIG. 5 are illustrations of a mounting and demounting operation of the developing device.

Figure 6:
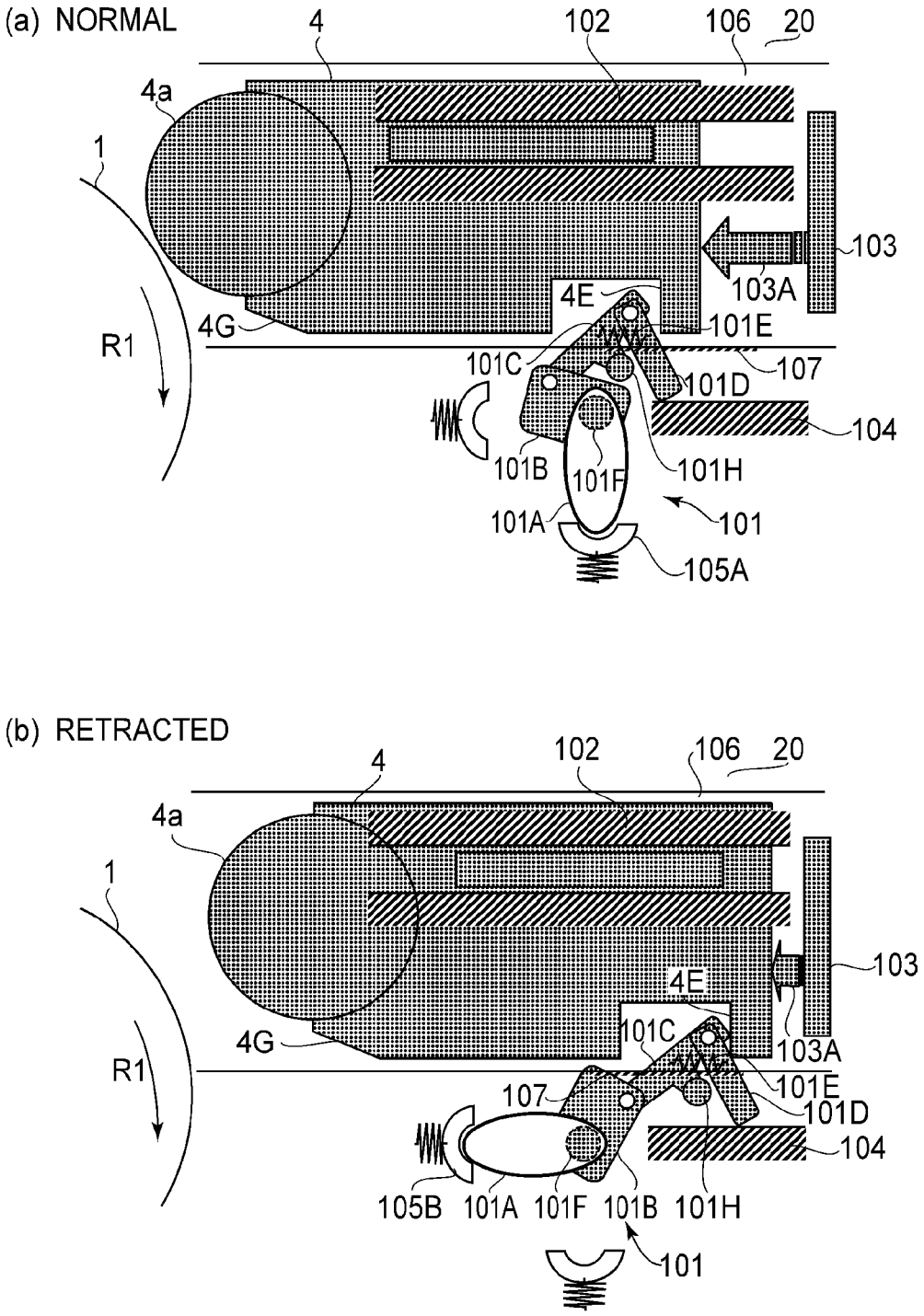

Part (a) and (b) of FIG. 6 are illustrations of a spacing operation of a developing device in Embodiment 2.

DESCRIPTION OF THE PREFERRED EMBODIMENTS

Embodiments of the present invention will be described in detail with reference to the drawings. The present invention can also be carried out in other embodiments in which a part or all of constitutions in the following embodiments are replaced with their alternative constitutions so long as a developing device is demountable in a direction in which a developer carrying member is spaced from an image bearing member.

Therefore, the present invention can be carried out by the image forming apparatus including the developing device irrespective of the types of development, charging and electrostatic image formation and irrespective of the types of intermediary transfer, recording material conveyance, transfer belt and sheet-feed printing.

In the following embodiments, only principal portions relating to formation of a toner image will be described but the present invention can be carried out in various uses such as a printer, various printing machines, a copying machine, a facsimile machine and a multi-function machine by adding necessary device, equipment and casing structure.

Incidentally, general matters of the image forming apparatuses described in JP-A Hei 11-133730, JP-A Hei 7-92801 and JP-A Hei 11-327296 will be omitted from illustration and redundant description.

<Image Forming Apparatus>

Figure 1:
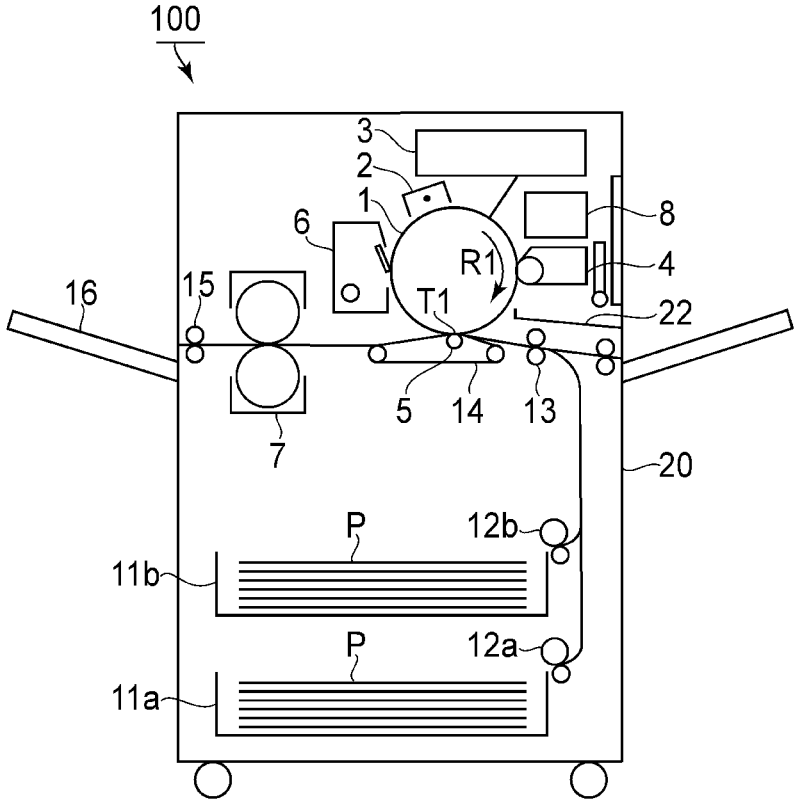
FIG. 1 is an illustration of a structure of an image forming apparatus.

FIG. 1 is an illustration of a structure of the image forming apparatus. As shown in FIG. 1, an image forming apparatus 100 is a high-speed monochromatic printer in which the toner image formed on a photosensitive drum 1 is transferred onto a recording material P carried on a transfer belt 14. To a casing 20, the photosensitive drum 1 and a developing device 4 are detachably mounted.

A corona charger 2, an exposure device 3, the developing device 4, a transfer roller 5 and a drum cleaning device 6 are disposed around the photosensitive drum 1 which is an example of the image bearing member. The photosensitive drum 1 is prepared by forming a photosensitive layer on an outer peripheral surface of an aluminum cylinder and is rotated in a direction indicated by an arrow R1 at a process speed of 700 mm/sec.

The corona discharger 2 uniformly charges the surface of the photosensitive drum 1 to a negative potential by irradiating the surface of the photosensitive drum 1 with charged particles by corona discharge. The exposure device 3 writes (forms) an electrostatic image for an image on the charged surface of the photosensitive drum 1 by scanning the photosensitive drum 1 surface with a laser beam, through a rotating mirror, which has been subjected to ON-OFF modulation of scanning line image data developed from an input image. The developing device 4 develops the electrostatic image formed on the photosensitive drum 1 into the toner image by using a one-component developer.

The transfer roller 5 presses an inner surface of the transfer belt 14 to form a transfer portion T1 between the photosensitive drum 1 and the transfer belt 14. The recording material P accommodated in a recording material cassette 11*a* is separated one by one by a separation roller 12*a* and is fed to registration rollers 13. The registration rollers 13 receive the recording material P in a rest state to place the recording material P in a stand-by state and then send the recording material P by being timed to the toner image on the photosensitive drum 1.

By applying a positive DC voltage to the transfer roller 5, the toner image carried on the photosensitive drum 1 is transferred onto the recording material P which is carried on the transfer belt 14 and passes through the transfer portion T1. The drum cleaning device 6 rubs the photosensitive drum 1 with a cleaning blade to collect transfer residual toner remaining on the photosensitive drum 1 without being transferred onto the recording material P.

The recording material P on which the toner image is transferred is separated by curvature from the transfer belt 14 and is sent into a fixing device 7. The recording material P is subjected to heat and pressure by the fixing device 7 to heat-fix the toner image on its surface and thereafter is discharged on a discharge tray 16 through discharging rollers 15.

<Developing Device>

Figure 2:
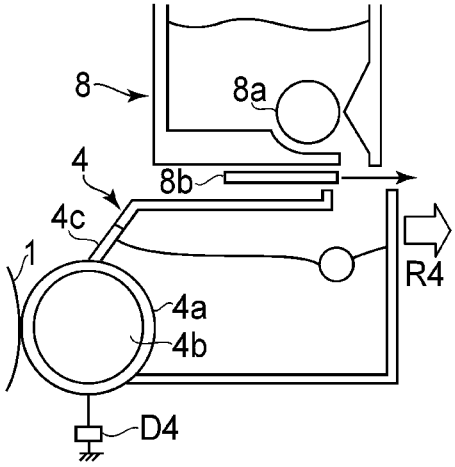
FIG. 2 is an illustration of a structure of a developing device.

FIG. 2 is an illustration of the developing device. As shown in FIG. 2, the developing device 4 carries the developer on a developing sleeve 4*a* which is an example of the developer carrying member and develops the electrostatic image into the toner image on the photosensitive drum 1. The developing device 4 carries magnetic toner (one-component developer) in a thin layer state on the developing sleeve 4*a* rotating around a fixed magnet 4*b* and feeds the magnetic toner to an opposing portion where the magnetic toner opposes the photosensitive drum 1.

A layer thickness regulating blade 4*c* regulates a layer thickness of the magnetic toner carried on the developing sleeve 4*a* and electrically charges the magnetic toner by friction. A power source D4 applies an oscillating voltage, in the form of a DC voltage biased with an AC voltage, the developing sleeve 4*a* to transfer the magnetic toner charged and carried on the developing sleeve 4*a* onto the photosensitive drum 1, so that the electrostatic image is reversely developed to form the toner image.

A developer supplying device 8 stores the magnetic toner supplies the magnetic toner in an amount corresponding to a consumption amount during image formation by rotating a supply magnet 8*a*.

Incidentally, the image forming apparatus includes a mechanism for releasing the contact between the photosensitive drum and the developing sleeve by releasing the urging (pressing) without mounting and demounting the developing device during the maintenance or the like of the photosensitive drum. This mechanism enables a maintenance operation of the photosensitive drum, to which the developing sleeve is contacted, by a simple operation such that the developing device is only spaced without being mounted and demounted, so that the mechanism is very effective from the viewpoint of reduction in maintenance time.

As a conventional mechanism for spacing (contact-releasing) the developing device, those described in JP-A Hei 11-133730 and JP-A Hei 7-92801 were used. However, in the mechanism described in JP-A Hei 11-133730, a mounting and demounting direction (front surface direction) of the developing device and a spacing direction (side surface direction) of the developing sleeve are different from each other and therefore in addition to the space for mounting and demounting the developing device, a space for realizing the contacting means releasing while urging the developing device is required. For this reason, as a result, there arose a problem such that a size of the image forming apparatus was increased.

Further, it would be considered that a constitution in which the moving mechanism of the developing device described in JP-A Hei 11-133730 and JP-A Hei 7-92801 is demountable from the casing before the demounting of the developing device or is retracted from a demounting path of the developing device by being rotated together with a door before the demounting of the developing device is employed. However, it would be considered that the addition of the demounting or retracting operation which is poor in intuitive correlation with a pulling-out operation of the developing device is not preferable since a procedure of the pulling-out operation becomes complicated. When a structure on the demounting side or on the door side becomes complicated, there are disadvantages also in terms of positioning accuracy and manufacturing cost.

Further, in the image forming apparatus, in order that a user can intuitively understand the operation for moving the developing device, it is desirable that the manual operation member is disposed closer to the developing device than those described in JP-A Hei 11-133830 and JP-A Hei 8-92801. Further, it is preferable that the operation of the manual operation member is set so that the operation of rotating the manual operation member is intuitively associated with the movement of the developing device more than those described in JP-A Hei 11-133730 and JP-A Hei 7-92801. This is because an operating procedure can be made easy to be mastered to prevent error in operation by an intuitively understandable operation for forming a predetermined spacing between the image bearing member and the developer carrying member.

In the following embodiments, in order to remedy these circumstances, a constitution in which a mechanism for spacing the developing sleeve is retracted from the space for mounting and demounting of the developing device during the mounting and demounting of the developing device is employed. As a result, the mounting and demounting direction of the developing device and the spacing direction of the developing sleeve can be made substantially identical to each other. The developing sleeve is spaced from the photosensitive drum by releasing the urging of the developing device without mounting and demounting the detachably mountable developing device mounted to the casing during the maintenance of the photosensitive drum.

Embodiment 1

Parts (1) to (c) of FIG. 3 are illustrations of a mechanism for mounting and demounting the developing device and for releasing contact of the developing device. Parts (a) and (b) of FIG. 4 are illustrations of a spacing operation of the developing device. Parts (a) and (b) of FIG. 5 are illustrations of a mounting and demounting operation of the developing device.

As shown in (a) of FIG. 3, the developing device 4 is urged by an urging mechanism 103 detachably mountable to the photosensitive drum 1, so that the developing sleeve 4*a* is contacted to the photosensitive drum 1. The developing device 4 is guided by a rail 102 and is supported movably in the horizontal direction. The developer supplying device 8 is guided by a rail 202 and is supported movably in the horizontal direction.

As shown in (c) of FIG. 3, the developing device 4 is configured, during the maintenance of the photosensitive drum 1, to open an outer cover 21 of a casing 20 rearward and then to be demounted from the casing 20 by being pulled out in a direction indicated by an arrow R4 after the urging mechanism 103 is tilted toward the side surface. The urging mechanism 103 can be tilted toward the side surface by releasing a fixed hook 103B. The urging mechanism 103 urges the developing device 4 toward the photosensitive drum 1 by an urging spring 103A in a state in which the urging mechanism 103 is engaged with the fixed hook 103B to rise.

As shown in (b) in FIG. 3, the developing device 4 is provided with a spacing forming mechanism 101 (FIG. 4) for spacing the developing sleeve 4*a* from the photosensitive drum 1, i.e., for releasing a developing pressure between the developing sleeve 4*a* and the photosensitive drum 1. A developing pressure releasing direction of the spacing forming mechanism 101 (FIG. 4) is identical to the demounting direction of the developing device 4.

By rotating releasing lever 101A, which is an example of the manual operation member, 90 degrees from the state of (a) of FIG. 3 in a direction indicated by an arrow R101, the developing device 4 is moved in a direction indicated by an arrow R4 to form the predetermined spacing between the developing sleeve 4*a* and the photosensitive drum 1. The releasing lever 101A is disposed close to the developing device 4 and the operation of the releasing lever 101A is set so that the rotating operation is intuitively associated with the movement of the developing device 4. Thus, the operation for forming the predetermined spacing between the photosensitive drum 1 and the developing sleeve 4*a* is made understandable intuitively, so that the operating procedure for releasing the developing pressure is easy for the user (operator) to be mastered to prevent error in operation.

As shown (a) of FIG. 4, the rail 102 which is an example of the guide portion guides the developing device 4 demountably from the casing 20 in a direction in which the developing sleeve 4*a* is spaced from the photosensitive drum 1.

The urging spring 103A which is an example of an urging means (urging mechanism) urges the developing device 4, guided by the rail 102, toward the photosensitive drum 1.

The spacing forming mechanism (moving mechanism) 101 moves the developing device 4 against the urging of the urging spring 103A by operating the releasing lever 101A which is the example of the manual operation member, thus forming the predetermined spacing between the photosensitive drum 1 and the developing sleeve 4*a* as shown in (b) of FIG. 4. The spacing forming mechanism 101 is provided movably in a movement path of the developing device 4 and spaces the developing sleeve 4*a* from the photosensitive drum 1 by moving the position of the developing device 4 from a developing position to a retracted position retracted from the developing position.

The spacing forming mechanism 101 is retracted to a position, by the movement of the developing device 4 during the demounting from the casing 20, in which the movement is not prevented, and is restored to a position, by the movement of the developing device 4 during the mounting to the casing 20, in which the predetermined spacing is formable.

The spacing forming mechanism 101 includes the releasing lever 101A, a base side arm 101B, an urging arm 101C, an end side arm 101D, a tension spring 101E and a rotation shaft 101F.

The urging arm 101C which is an example of an urging member urges the developing device 4 so as to form the predetermined spacing by moving in a plane parallel to a plane of rotation of the releasing lever 101A. The urging arm 101C is urged so as to project toward the developing device and is, as shown in (a) of FIG. 5, pressed by the developing device 4 demounted from the casing 20 to be retracted, against the urging, to a position in which the movement of the developing device 4 is not prevented. The urging arm 101C moves in the movement path in which the developing device 4 moves during the mounting thereof, thus forming the predetermined spacing between the photosensitive drum 1 and the developing sleeve 4*a*. Further, the urging arm 101C is provided so that it can be retracted to an outside of the movement path by the movement of the developing device 4 during the demounting from the casing 20.

The base side arm 101B which is an example of a first arm member rotates together with the releasing lever 101A and is provided so that the urging arm 101C is rotatable in the plane parallel to the plane of rotation of the releasing lever 101A.

The end side arm 101D which is an example of a second arm member is mounted, on end side of the urging arm 101C, rotatable in the plane parallel to the plane of rotation of the releasing lever 101A. The end side of the urging arm 101C is an end portion which is located opposite from the base side arm 101B and which is connected to the end side arm 101D. The end side arm 101D is provided retractably from the inside of the movement path of the developing device 4 to the outside of the movement path of the developing device 4.

The tension spring 101E urges the urging arm 101C so as to project toward the developing device 4 on a rotation side of the urging arm 101C in a direction in which a crossing angle between the urging arm 101C and the end side arm 101D is decreased.

A rail 104 which is an example of a guide surface guides the end side arm 101D in the movement direction of the developing device 4 while supporting an end side of the end side arm 101D. The end side of the end side arm 101A is a rotation end of the end side arm 101D.

A rotation stopper 101G which is an example of a projection amount regulating means limits a projection amount of the urging arm 101C moved toward the developing device while being urged by the tension spring 101E. The rotation stopper 101G is a means for setting a minimum crossing angle between the urging arm 101C and the end side arm 101D which are urged by the tension spring 101E.

That is, the rotation shaft 101F is rotatably supported by the casing 20 and to which the releasing lever 101A and the base side arm 101B are mounted. For that reason, in interrelation with the rotation of the releasing lever 101A by the user (service person), the base side arm 101B is rotated.

The urging arm 101C is shaft-supported by the base side arm 101B on a side close to the rotation shaft 101F and is shaft-supported by the end side arm 101D on a side remote from the rotation shaft 101F. The tension spring 101E is set so as to decrease the crossing angle (angle of aperture) between the urging arm 101C and the end side arm 101D, so that both of the arms 101C and 101C rotate in a direction in which the angle of aperture is decreased until the end side arm 101D abuts against the rotation stopper 101G when there is particularly no another force. The end of the end side arm 101D on the side opposite from the side where the end side arm 101D is shaft-supported is configured to slide on the rail 104 while being guided along the rail 104.

In order to place the releasing lever 101A in a standing state while ensuring clock feeling, a rotation stopper 105A for rotation-holding (preventing) the releasing lever 101A at a standing position is provided. In order to place the releasing lever 101A in a horizontal state while ensuring click feeling, a rotation stopper 105B for rotation-holding (preventing) the releasing lever 101A in a state in which the releasing lever 101A is on its side is provided.

(1) Normal State

As shown in (a) of FIG. 4, in a normal state, the releasing lever 101A is set at the standing position by the user, thus being rotation-prevented by the rotation stopper 105A. As a result, the base side arm 101B interrelated with the releasing lever 101A pulls the urging arm 101C toward the photosensitive drum 1 side, so that the urging arm 101C is spaced from an abutment surface 4E of the developing device 4.

At this time, the urging arm 101C and the end side arm 101D are interrelated with each other to be moved to the position of the base side arm 101B and are urged by the tension spring 101E in the direction in which the angle of aperture therebetween is decreased. Further, the end of the end side arm 101D is supported by the rail 104.

In this state, the spacing forming mechanism 101 does not affect a horizontal urging force on the developing device 4 and therefore the developing device 4 is urged toward the photosensitive drum 1 by the urging mechanism 103, so that a normal developing operation can be performed. At this time, by the tension spring 101E, the urging arm 101C and the end side arm 101D are urged in the direction in which the angle of aperture is decreased, so that a force for urging the developing device 4 by the urging arm 101C from below is generated. However, the force of the tension spring 101E is sufficiently smaller than the force of the urging mechanism 103 and therefore does not affect the urging of the developing device 4.

(2) During Release of Developing Pressure

As shown in (b) of FIG. 4, during the release of developing pressure, the releasing lever 101A is set at the horizontal position by the user, thus being rotation-prevented by the rotation stopper 105B. As a result, the base side arm 101B interrelated with the releasing lever 101A moves the urging arm 101C toward a side opposite from the photosensitive drum 1 side, so that the urging arm 101C is urged against the abutment surface 4E of the developing device 4.

At this time, the urging arm 101C and the end side arm 101D are moved in interrelation with the base side arm 101B and are urged by the tension spring 101E in the direction in which the angle of aperture therebetween is decreased. Further, the end of the end side arm 101D is supported by the rail 104.

As a result, the urging arm 101C somewhat moves the developing device 4, against the urging force of the urging spring 103A, in a direction in which the developing device 4 is moved away from the photosensitive drum 1 and holds a resultant state. The developing device 4 overcomes the urging by the urging mechanism 103 and is moved rearward by the urging arm 101C to be spaced from the photosensitive drum 1, so that it becomes possible to perform the demounting, mounting, maintenance or the like of the photosensitive drum 1 or the like without demounting the developing device 4.

(3) During Demounting of Developing Device

As shown in (a) of FIG. 5, when the developing device 4 is demounted from the casing 20 for the purpose of the maintenance or the like of the developing device 4 itself, the developing device 4 is demounted from the casing 20 through a mounting and demounting path 106. At this time, the urging arm 101C and the end side arm 101D constitute an obstacle to the demounting of the developing device 4. However, the urging arm 101C and the end side arm 101D are configured so that they are retractable downward and therefore they are urged downward by a bottom surface of the moving developing device 4 to be retracted from the mounting and demounting path 106. The urging arm 101C and the end side arm 101D are retracted from the mounting and demounting path 106, so that the developing device 4 can be demounted from the casing 20.

As shown in (b) of FIG. 5, after the developing device 4 is demounted from the casing 20, the urging arm 101C and the end side arm 101D are urged by the tension spring 101E to be rotated in the direction in which the angle of aperture is decreased, thus being returned to the state shown in (a) of FIG. 4. For this reason, the spacing forming mechanism 101 projects into the mounting and demounting path 106 again and constitutes an obstacle to the mounting movement of the developing device 4 now.

However, when the developing device 4 is mounted, the urging arm 101C and the end side arm 101D are guided by an inclined surface 4G of the developing device 4 and are pressed downward, so that they are retracted from the mounting and demounting path 106, so that the developing device 4 can be mounted to the casing 20.

The inclined surface 4G is formed on a front side of the developing device 4 which is moved toward the photosensitive drum 1 while being guided by the rail 102 and causes the urging arm 101C to be retracted to the position, in which the movement of the developing device 4 is not prevented, by the movement of the developing device 4.

Thereafter, when the developing device 4 is returned to a predetermined state shown in (a) of FIG. 4, the urging arm 101C and the end side arm 101D are urged by the tension spring 101E in the direction, in which the angle of aperture is decreased, to rise and thus they are spaced from the abutment surface 4E. Further, as shown in (b) of FIG. 4, the spacing forming mechanism 101 is actuated by operating the releasing lever 101A and thus can release the developing pressure.

According to the constitution of Embodiment 1, the mounting and demounting direction of the developing device 4 and the spacing direction of the developing device 4 are substantially identical to each other, so that the space for the mounting and demounting and the space for the spacing of the developing device 4 while urging the developing device 4 can be shared. As a result, the casing in which the photosensitive drum and the developing device are accommodated is downsized to realize space saving of the image forming apparatus, so that the image forming apparatus can be downsized. The releasing lever for releasing the developing pressure is intuitively operated to move the developing device in the mounting and demounting path, so that the predetermined spacing can be set between the developing sleeve and the photosensitive drum.

Further, the operation for forming the predetermined spacing between the image bearing member and the developer carrying member can be intuitively understood and the mechanism for forming the predetermined spacing does not prevent the demounting of the developing device physically and mentally.

Embodiment 2

Parts (a) and (b) of FIG. 6 are illustrations of a spacing operation of a developing device in this embodiment.

As shown in (a) of FIG. 6, in this embodiment, different from Embodiment 1, the urging arm 101C is provided with an upward movement preventing member 101H, so that the projection amount of the urging mechanism 101C is regulated by a rail 107. The upward movement preventing member is configured to be moved along the rail 107 to prevent the urging arm 101C from moving in the upward direction by a distance which is not less than a certain distance.

The rail 107 which is another example of the guide surface guides the upward movement preventing member, which is an example of a roller member providing a rotation axis to the urging arm 101C, in the movement direction of the developing device 4 so as to limit the projection amount.

(1) Normal State

As shown in (a) of FIG. 6, in a normal state, the releasing lever 101A is set in the standing state by the user, thus being rotation-prevented by the rotation stopper 105A. As a result, the base side arm 101B interrelated with the releasing lever 101A pulls the urging arm 101C toward the photosensitive drum 1 side, so that the urging arm 101C is spaced from an abutment surface 4E of the developing device 4.

At this time, the urging arm 101C and the end side arm 101D are moved in interrelation with the base side arm 101B and are urged by the tension spring 101E in the direction in which the angle of aperture therebetween is decreased. Further, the end of the end side arm 101D is supported by the rail 104.

In this state, the spacing forming mechanism 101 does not exert the horizontal urging force on the developing device 4 and therefore the developing device 4 is urged toward the photosensitive drum 1 by the urging mechanism 103, so that the developing device 4 can perform a normal developing operation. Further, at this time, the urging arm 101C and the end side arm 101D are urged by the tension spring 101E in the direction in which the angle of aperture is decreased, so that a force for moving the urging arm 101C upward is generated. However, the upward movement preventing member 101H is stopped by the rail 107 and therefore the urging arm 101C does not push up the developing device 4, so that the urging arm 101C does not exert an excessive force on the developing device 4 by contact.

(2) During Release of Developing Pressure

As shown in (b) of FIG. 4, during the release of developing pressure, the releasing lever 101A is set at the horizontal position by the user, thus being rotation-prevented by the rotation stopper 105B. As a result, the base side arm 101B interrelated with the releasing lever 101A moves the urging arm 101C toward a side opposite from the photosensitive drum 1 side, so that the urging arm 101C is urged against the abutment surface 4E of the developing device 4.

At this time, the urging arm 101C and the end side arm 101D are moved in interrelation with the base side arm 101B and are urged by the tension spring 101E in the direction in which the angle of aperture therebetween is decreased. Further, the urging arm 101C receives reaction force from the developing device 4. The upward movement preventing member 101H is held along the rail 107. The end of the end side arm 101D is held along by the rail 104.

As a result, the urging arm 101C somewhat moves the developing device 4, against the urging force of the urging spring 103A, in a direction in which the developing device 4 is moved away from the photosensitive drum 1 and holds a resultant state. The developing device 4 overcomes the urging by the urging mechanism 103 and is moved rearward by the urging arm 101C to be spaced from the photosensitive drum 1, so that it becomes possible to perform the demounting, mounting, maintenance or the like of the photosensitive drum 1 or the like without demounting the developing device 4.

Further, the urging arm 101C receives the reaction force from the developing device 4, so that the force for moving the urging arm 101C upward is generated. However, this force is received by the upward movement preventing member 101H and therefore it is possible to realize the release of the developing pressure without exerting the upward force of the urging arm 101C on the developing device 4.

In the present invention, the spacing forming mechanism capable of moving away from the developing device detachably mountable to the casing without being mounted to and demounted from the photosensitive drum. Further, the mounting and demounting direction of the developing device and the pressure releasing direction are made substantially identical to each other, so that the space used for the mounting and demounting the developing device and for releasing the developing pressure is saved.

Further, the release of the developing pressure is performed by a combination with the releasing arm, so that the spacing forming mechanism can be retracted from the mounting and demounting space for the developing device in the system in which the developing device mounting and demounting direction and the developing pressure releasing direction are the same direction, thus realizing further space saving.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 004888/2010 filed Jan. 13, 2010, which is hereby incorporated by reference.

What is claimed is:

1. An image forming apparatus comprising:

an image bearing member;

a developing device for forming a toner image on said image bearing member while carrying a developer on a developer carrying member, wherein said developing device is mountable and demountable relative to a main assembly of said apparatus in a direction substantially parallel with a radial direction of said image bearing member;

an urging mechanism for urging said developing device toward the surface of said image bearing member; and a moving mechanism, movable in a movement path of said developing device, for moving said developing device between a developing position in which development can be effected and a retracted position retracted from the developing position in a state in which said developing device is urged by said urging mechanism, wherein said moving mechanism is temporarily retracted from an inside of the movement path of said developing device to an outside of the movement path of said developing device by a mounting and demounting operation of said developing device.

2. An apparatus according to claim 1, wherein said moving mechanism include an engaging portion for engaging with a recessed portion provided on said developing device, wherein the engaging portion is moved inside the movement path to move said developing device between the developing position and the retracted position in the state in which said developing device is urged by said urging mechanism.

3. An apparatus according to claim 2, wherein the engaging portion is urged so as to be projected toward said developing device, wherein the engaging portion is retracted to a position, in which the movement of said developing device is not prevented, against the urging by being pressed against said developing device by the demounting operation of said developing device, and wherein the engaging portion is restored to the inside of the movement path when said developing device is demounted.

* * * * *